US008342802B1

(12) United States Patent
Liang

(10) Patent No.: US 8,342,802 B1
(45) Date of Patent: Jan. 1, 2013

(54) THIN TURBINE BLADE WITH NEAR WALL COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 780 days.

(21) Appl. No.: 12/766,248

(22) Filed: Apr. 23, 2010

(51) Int. Cl.
*F01D 5/18* (2006.01)

(52) U.S. Cl. ..... 416/96 A; 415/116; 416/97 R; 416/233

(58) Field of Classification Search ..... 415/115, 415/116; 416/91, 97 R, 97 A, 96 A, 226, 416/229 A, 233, 241 B, 1
See application file for complete search history.

(56) References Cited

U.S. PATENT DOCUMENTS 2,873,944 A * 2/1959 Wiese et al. ..... 416/92
5,704,763 A * 1/1998 Lee ..... 416/96 R
5,752,801 A * 5/1998 Kennedy ..... 415/115
6,837,683 B2 * 1/2005 Dailey ..... 416/97 R
6,910,864 B2 * 6/2005 Tomberg ..... 416/90 R
7,690,892 B1 * 4/2010 Liang ..... 416/1
7,753,650 B1 * 7/2010 Liang ..... 416/97 R
8,047,789 B1 * 11/2011 Liang ..... 416/97 R
8,262,355 B2 * 9/2012 Kopmels ..... 416/96 R

* cited by examiner

*Primary Examiner* — Edward Look
*Assistant Examiner* — Liam McDowell
(74) *Attorney, Agent, or Firm* — John Ryznic

(57) ABSTRACT

A large and highly tapered and twisted turbine rotor blade for a large frame and heavy duty industrial gas turbine engine, where the blade includes a main spar with multiple impingement chambers extending along the chordwise direction of the blade, and with a thin thermal skin bonded to the main spar to form an airfoil section for the blade. The chordwise impingement channels are separated by ribs to form multiple chambers in the spanwise direction from the root to the blade tip. These compartmented impingement channels formed along the airfoil spanwise direction can be used for tailoring the gas side pressure variation in the spanwise direction, and individual impingement channels can be designed based on the airfoil local external heat load to achieve a desired local metal temperature. With this cooling circuit, the usage of cooling air is maximized for a given airfoil inlet gas temperature and pressure profile.

4 Claims, 3 Drawing Sheets

View A-A

View B-B

THIN TURBINE BLADE WITH NEAR WALL COOLING

GOVERNMENT LICENSE RIGHTS

None.

CROSS-REFERENCE TO RELATED APPLICATIONS

None.

BACKGROUND OF THE INVENTION

1. Field of the Invention

The present invention relates generally to gas turbine engine, and more specifically to a large highly tapered and twisted and thin turbine rotor blade with multiple impingement near wall cooling.

2. Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

As the turbine inlet temperature increases with higher efficiency engines, later stages of the turbine rotor blades will require cooling. The latter stages of blades are also large blades with high amounts of taper and twist. The fourth stage turbine rotor blade can be over three feet in spanwise length and is too thin for most types of internal cooling circuits. For a large turbine rotor blade, cooling holes are drilled radial holes from the blade tip to the root section. Limitations of drilling a long radial hole from both ends of the airfoil increases for a large and highly twisted blade. A reduction of the available airfoil cross sectional area for drilling radial holes is a function of the blade twist. Higher airfoil twist yields a lower available cross sectional area for drilling radial cooling holes because a straight path from the tip to the root is not available. Cooling of the large and highly twisted blade by this manufacturing process will not achieve the optimum blade cooling effectiveness. U.S. Pat. No. 6,910,864 issued to Tomberg on Jun. 28, 2005 and entitled TURBINE BUCKET AIRFOIL COOLING HOLE LOCATION, STYLE AND CONFIGURATION shows a profile view of a prior art large rotor blade cooling design with drilled radial cooling holes as described above.

Alternative designs to the radial cooling channels for these large and highly twisted turbine rotor blades have been proposed such as the use of multiple pass serpentine flow or multiple radial channels with pin fins for cooling. However, producing a ceramic core to achieve an acceptable casting yield for a large tapered and twisted blade has not been found. Ceramic cores must be made into more than one piece which leads to core shifting during the casting process or from core pieces breaking such that the cooling circuit is not completely formed.

BRIEF SUMMARY OF THE INVENTION

A large and highly tapered and twisted turbine rotor blade for a large frame and heavy duty industrial gas turbine engine, where the blade includes a main spar with multiple impingement chambers extending along the chordwise direction of the blade, and with a thin thermal skin bonded to the main spar to form an airfoil section for the blade. The chordwise impingement channels are separated by ribs to form multiple chambers in the spanwise direction from the root to the blade tip. These compartmented impingement channels formed along the airfoil spanwise direction can be used for tailoring the gas side pressure variation in the spanwise direction, and individual impingement channels can be designed based on the airfoil local external heat load to achieve a desired local metal temperature. With this cooling circuit, the usage of cooling air is maximized for a given airfoil inlet gas temperature and pressure profile.

DETAILED DESCRIPTION OF THE INVENTION

Figure 1:
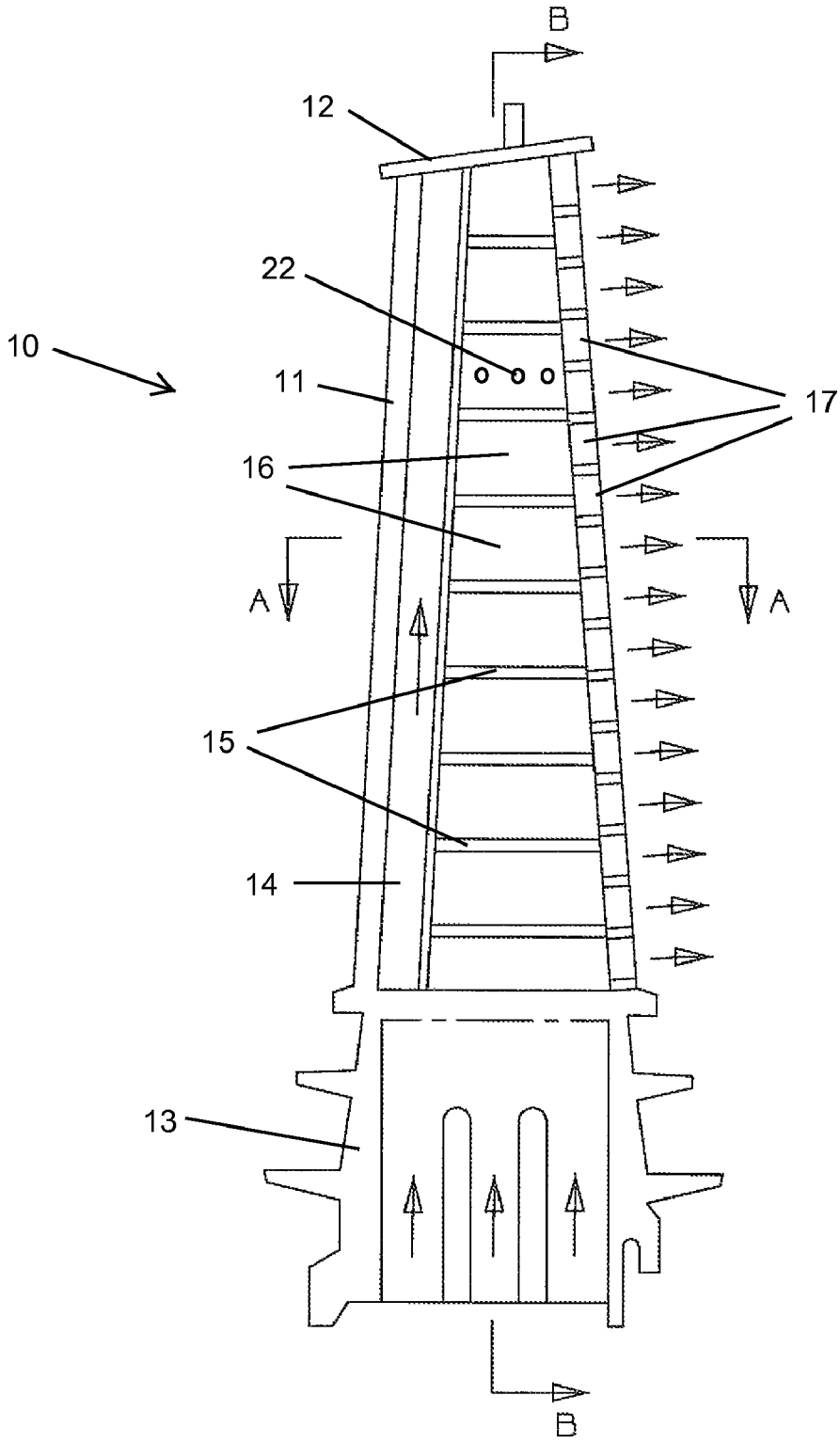
FIG. 1 shows a cross section side view of the large turbine rotor blade of the present invention.
Figure 2:
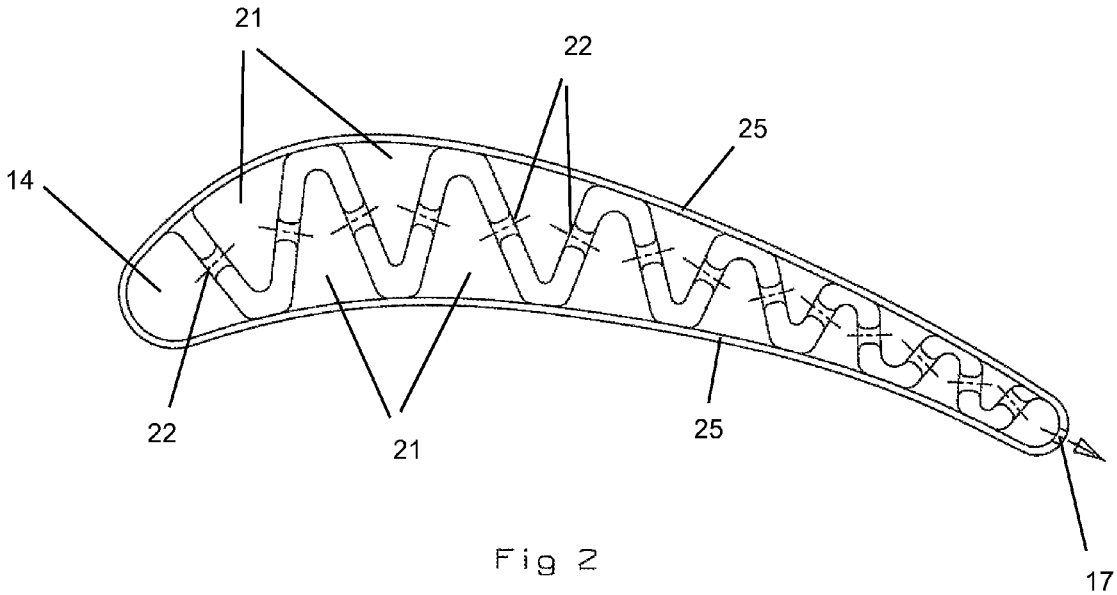
FIG. 2 shows a cross section view from the top through line A-A in FIG. 1 of the blade of the present invention.
Figure 3:
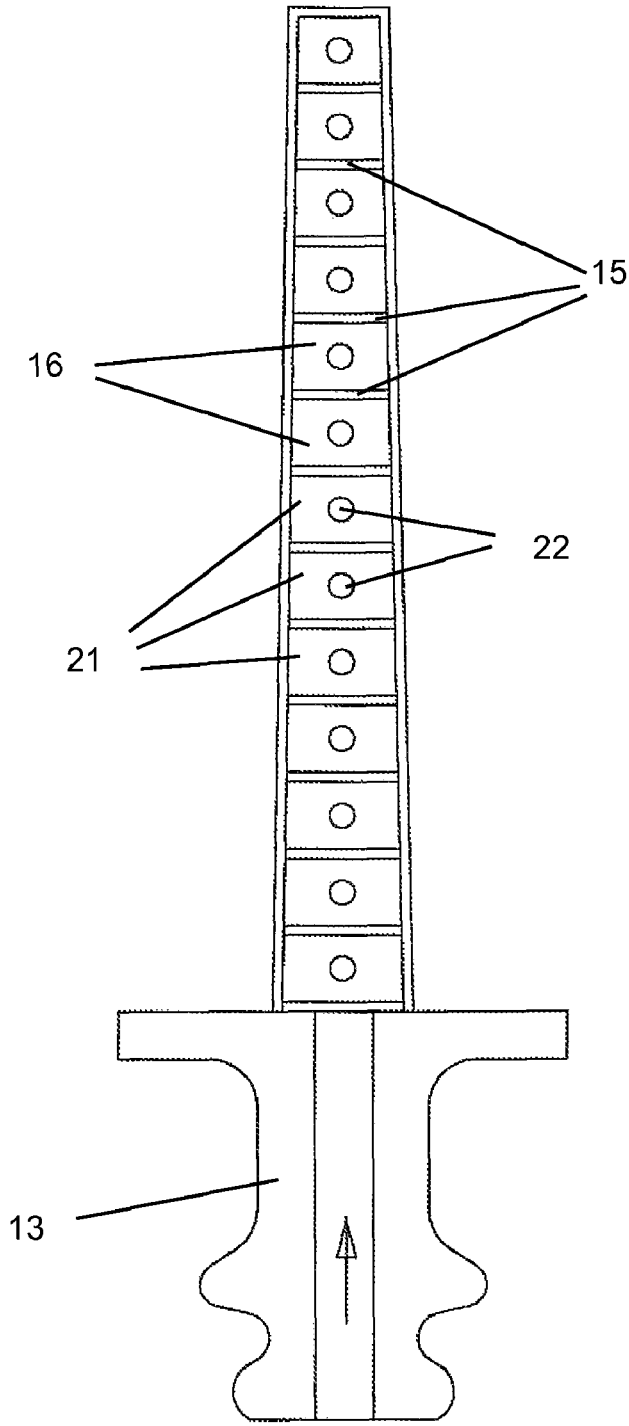
FIG. 3 shows a cross section view from the front through line B-B in FIG. 1 of the blade of the present invention.

A large and highly tapered and twisted turbine rotor blade for an industrial gas turbine engine is shown in FIGS. 1 through 3. The blade 10 in FIG. 1 includes an airfoil section 11 extending between a blade tip 12 and a root section 13 that includes a platform. The blade is formed from a main spar with a thin thermal skin bonded to the spar to form the airfoil outer surface of the blade. The blade includes a leading edge (L/E) cooling air supply channel that extends from the root 13 to the blade tip 12. A series of chordwise extending ribs 15 form partition ribs to separate axial flow impingement channels 16 formed between adjacent ribs 15. The axial impingement channels extend from the L/E cooling air supply channel to the trailing edge (T/E) region of the blade. A row of cooling air exit holes 17 are located along the T/E or to the side and extend from the platform to the blade tip 12 and connect the impingement channels 16 to discharge the cooling air.

FIG. 2 shows a cross section view of one of the axial flow impingement channels 16 with the L/E cooling air supply channel 14 located at the L/E of the airfoil and the cooling air exit hole 17 located at the T/E. Each of the channels 16 is formed by the main spar extending from the pressure side (P/S) wall to the suctions side (S/S) wall in an alternating back-and-forth manner as seen in FIG. 2. The main spar forms a series of impingement cavities 21 connected by a series of impingement holes 22 formed in the main spar. The impingement holes 22 direct the cooling air from the impingement cavity toward the backside surface of the P/S or S/S surface of the thin thermal skin 25 that wraps around the main spar along the L/E and along both the P/S and S/S walls of the airfoil. The last impingement cavity 21 is located along the T/E region and is connected to the T/E exit cooling hole 17.

FIG. 3 shows a cross section view of the blade through the line B-B in FIG. 1 with the root section 13 having a cooling air supply channel to supply cooling air to the L/E cooling air supply channel 14. FIG. 3 shows the axial flow impingement channels 16 separated by the ribs 15 and the impingement hole 22 for each impingement cavity.

For the construction of the spar core and thermal skin cooled turbine blade with the near wall multiple impingement cooling cavities, the blade spar core is cast (from conventional nickel super alloys using the investment casting process) with the built in mid-chord partition ribs. After casting, the slanted impingement holes are then machined into the spar core structure. Then, the thermal skin can be made from a different material than the cast spar core and secured to the spar core using a bonding process such as transient liquid phase (TLP) bonding process. The thermal skin can be formed as a single piece or from multiple pieces, and can be a high temperature resistant material relative to the spar core with a thickness of from 0.010 to 0.030 inches.

In operation, cooling air is supplied through the airfoil leading edge cooling feed or supply channel 14. Cooling air is then metered through each of the impingement holes 22 and directed to impinge onto the backside surface of the thin thermal skin 25, alternating from the P/S wall to the S/S wall along the chordwise direction of the airfoil. This multiple impingement process repeats from the blade L/E to the T/E, with the spent impingement cooling air discharged through the T/E exit holes 17. For a shrouded blade, a portion of the spent cooling air from the last spanwise axial flow channel 16 can be discharged to the blade tip shroud periphery to provide cooling for the blade tip shroud edge and hard face. For a free standing blade design, the spent cooling air is discharged through the blade T/E from each of the spanwise axial extending channels 16.

Major design features and advantages of the present invention over the prior art blade with serpentine cooling channels or drilled radial cooling channels are described below. The spar core is used to carry the blade loads and retain the structural integrity for the large turbine rotor blade. Elimination of casting with the use of a ceramic core for the cooling circuit and a simplified manufacturing process that produces an increased casting yield. The multiple impingement cooling cavities provides cooling throughout the entire airfoil surface including the blade tip shroud. The near wall cooling with a thin thermal skin enhances the blade cooling effectiveness by means of a reduced conduction path and a lower thermal gradient across the airfoil wall.

A double use of the cooling air is achieved. This cooling air is used to cool the airfoil wall first and then discharged at the tip shroud for edge cooling. This double use of the cooling air yields a very high overall blade cooling effectiveness. The blade cooling design of the present invention yields a lower and more uniform blade sectional mass average temperature at a lower blade span height which improves the blade creep like capability, especially since creep at lower blade span is an important issue to be addressed for a large and tall blade design such as the $3^{rd}$ and $4^{th}$ stage blades in an industrial gas turbine engine.

The blade cooling design of the present invention is inline with the blade creep design requirement. The cooling air increases temperature in the cooling supply channel as it flows upward along the leading edge and therefore induces a hotter sectional mass average temperature at the upper blade span. However, the pull stress at the blade upper span is low and the allowable blade metal temperature is high. However, for a large and tall blade, creep relaxation at the blade upper span is also an issue to be addressed. The spar core structure used in the chordwise flowing impingement cooling cavity design and the spanwise channel ribs provide for a very high airfoil chordwise sectional strength to prevent airfoil from untwisting.

Since the multiple impingement cooling cavities are used in the airfoil leading edge and trailing edge regions, the cooling air flow is initiated at the blade root section which provides for a cooler blade leading edge trailing edge corners and thus enhances the blade HCF capability.

I claim the following:

1. An air cooled turbine rotor blade comprising:

the blade being a tapered and twisted blade for use in an industrial gas turbine engine;

a leading edge cooling air supply channel located along the leading edge of the blade and extending from a platform to a blade tip;

a row of exit cooling holes spaced along the trailing edge of the blade;

a series of chordwise extending ribs extending from the platform to the blade tip and forming a series of chordwise extending impingement channels from the leading edge cooling supply channel to the row of exit cooling holes;

each of the chordwise extending channels forming a series of impingement cavities with a series of impingement holes; and, the impingement holes alternate from discharging impingement cooling air against a backside surface of a pressure side wall and a suction side wall of the blade.

2. The air cooled turbine rotor blade of claim 1, and further comprising:

the blade is formed from a spar core with a thin thermal skin bonded to the spar core to form the outer airfoil surface of the blade.

3. The air cooled turbine rotor blade of claim 1, and further comprising:

the chordwise extending channels form separate cooling air passages between the leading edge cooling supply channel and the trailing edge exit cooling holes.

4. The air cooled turbine rotor blade of claim 1, and further comprising:

the impingement cavities are formed by the spar core which includes walls that alternate from the pressure side to the suction side of the blade; and, the impingement holes are formed within the spar core walls.

* * * * *